US010284974B2

(12) United States Patent
Kazemzadeh et al.

(10) Patent No.: US 10,284,974 B2
(45) Date of Patent: May 7, 2019

(54) ACOUSTICALLY TRANSPARENT BARRIER LAYER TO SEAL AUDIO TRANSDUCERS

(71) Applicant: Starkey Laboratories, Inc., Eden Prairie, MN (US)

(72) Inventors: Farhad Kazemzadeh, Bloomington, MN (US); Robert Jacoby, Eden Prairie, MN (US); Gerald Shamla, Maple Lake, MN (US); Brian Dobson, Eden Prairie, MN (US); Richard Huynh, Eden Prairie, MN (US); Wei Li Lin, Plymouth, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 484 days.

(21) Appl. No.: 13/939,026

(22) Filed: Jul. 10, 2013

(65) Prior Publication Data

US 2015/0016648 A1 Jan. 15, 2015

(51) Int. Cl.
*H04R 25/00* (2006.01)

(52) U.S. Cl.
CPC ..... *H04R 25/652* (2013.01); *H04R 25/654* (2013.01); *H04R 25/658* (2013.01); *H04R 2225/77* (2013.01); *Y10T 29/49572* (2015.01)

(58) Field of Classification Search
USPC ..... 381/325, 328
See application file for complete search history.

(56) References Cited

U.S. PATENT DOCUMENTS 4,879,750 A 11/1989 Nassler
4,972,488 A 11/1990 Weiss et al.
4,987,597 A 1/1991 Haertl
5,864,628 A 1/1999 Posen et al.
6,068,911 A 5/2000 Shouji et al.
6,134,333 A 10/2000 Flagler
6,164,409 A * 12/2000 Berger ..... H04R 25/654 128/864
6,212,283 B1 4/2001 Fletcher et al.
6,310,961 B1 10/2001 Oliveira et al.

(Continued)

FOREIGN PATENT DOCUMENTS

EP 1432281 A2 6/2004
EP 1432285 A2 6/2004

(Continued)

OTHER PUBLICATIONS

"U.S. Appl. No. 13/404,496, Advisory Action dated Jan. 28, 2014", 3 pgs.

(Continued)

*Primary Examiner* — Yosef K Laekemariam

(74) *Attorney, Agent, or Firm* — Schwegman Lundberg & Woessner, P.A.

(57) ABSTRACT

Disclosed herein, among other things, are methods and apparatus for mitigating foreign material buildup for hearing assistance device components. The present subject matter includes a hearing assistance device transducer barrier layer configured to resist accumulation and passage of foreign materials. In various embodiments, the barrier layer includes a membrane that is coated with oleophobic and hydrophobic materials, wherein the barrier is acoustically transparent but prevents the accumulation and passage of unwanted materials.

33 Claims, 5 Drawing Sheets

(56) References Cited

U.S. PATENT DOCUMENTS

| | | | | |
|---|---|---|---|---|
| 6,449,373 | B2 | 9/2002 | Baker | |
| 6,671,381 | B1 * | 12/2003 | Lux-Wellenhof | 381/325 |
| 7,267,847 | B2 | 9/2007 | Karamuk | |
| 7,313,245 | B1 * | 12/2007 | Shennib | A61F 11/08 128/864 |
| 7,372,973 | B2 | 5/2008 | Meier | |
| 7,401,679 | B2 | 7/2008 | Ipsen | |
| 7,443,992 | B2 | 10/2008 | Fideler | |
| 7,499,561 | B2 | 3/2009 | Hanses et al. | |
| 7,551,747 | B2 | 6/2009 | Huynh et al. | |
| 7,751,579 | B2 | 7/2010 | Schulein et al. | |
| 7,773,764 | B2 | 8/2010 | Niederdrank | |
| 7,983,434 | B2 | 7/2011 | Röhrlein | |
| 8,416,974 | B2 | 4/2013 | Ammitzboll et al. | |
| 9,369,816 | B2 | 6/2016 | Yoong et al. | |
| 2003/0035917 | A1 * | 2/2003 | Hyman | B41M 1/30 428/67 |
| 2003/0196687 | A1 | 10/2003 | Campbell et al. | |
| 2003/0198360 | A1 * | 10/2003 | Niederdrank | 381/325 |
| 2004/0179709 | A1 | 9/2004 | Niederdraenk et al. | |
| 2005/0018866 | A1 | 1/2005 | Schulein et al. | |
| 2005/0084122 | A1 * | 4/2005 | Norris | B06B 1/0688 381/190 |
| 2005/0141738 | A1 | 6/2005 | Karamuk | |
| 2007/0047752 | A1 | 3/2007 | Wagner et al. | |
| 2008/0200779 | A1 | 8/2008 | Zimmerling et al. | |
| 2008/0240479 | A1 | 10/2008 | Linford | |
| 2008/0310660 | A1 | 12/2008 | Lin | |
| 2009/0154747 | A1 * | 6/2009 | Vestergaard et al. | 381/325 |
| 2010/0322452 | A1 | 12/2010 | Ladabaum et al. | |
| 2011/0015063 | A1 * | 1/2011 | Gil | A61L 15/22 502/402 |
| 2011/0182452 | A1 | 7/2011 | Lin | |
| 2012/0219167 | A1 * | 8/2012 | Yoong | H04R 25/654 381/325 |
| 2012/0237065 | A1 | 9/2012 | Higgins et al. | |
| 2014/0168864 | A1 * | 6/2014 | Lin | G02F 1/133308 361/679.01 |
| 2015/0382118 | A1 | 12/2015 | Vaishya | |

FOREIGN PATENT DOCUMENTS

| | | | |
|---|---|---|---|
| EP | 1458217 | A2 | 9/2004 |
| EP | 2003929 | A2 | 12/2008 |
| EP | 2003931 | A2 | 12/2008 |
| EP | 2493216 | A2 | 8/2012 |
| EP | 2501159 | A2 | 9/2012 |
| JP | 61203800 | A | 9/1986 |
| WO | WO-1993012626 | A1 | 6/1993 |
| WO | WO-1999048328 | A1 | 9/1999 |
| WO | WO-2003094574 | A1 | 11/2003 |
| WO | WO-2004104116 | A1 | 12/2004 |
| WO | WO-2007005852 | A2 | 1/2007 |
| WO | WO-2007005866 | A2 | 1/2007 |
| WO | WO-2008025355 | A1 | 3/2008 |
| WO | WO-2008080397 | A1 | 7/2008 |
| WO | WO-2008154954 | A1 | 12/2008 |
| WO | WO-0103468 | A2 | 1/2011 |

OTHER PUBLICATIONS

"U.S. Appl. No. 13/404,496, Response filed Jan. 29, 2014 to Advisory Action dated Jan. 28, 2014 and Final Office Action dated Oct. 29, 2013", 7 pgs.
"U.S. Appl. No. 13/404,496, Response filed Dec. 30, 2013 to Final Office Action dated Oct. 29, 2013", 8 pgs.
Boersma, Paul, "Accurate Short-Term Analysis of the Fundamental Frequency and the Harmonics-to-Noise Ratio of a Sampled Sound", Institute of Phonetic Sciences, University of Amsterdam, Proceedings 17, (1993), 97-110.
Chou, Wen-Sheng, et al., "A binaural algorithm for space and pitch detection", 2011 IEEE International Conference on Acoustics, Speech and Signal Processing (ICASSP), (2011), 4976-4979.
Mitre, Adriano, et al., "Accurate and Efficient Fundamental Frequency Determination from Precise Partial Estimates", Proceedings of the 4th AES Brazil Conference, (2006), 113-118.
Noll, A. Michael, "Pitch Determination of Human Speech by the Harmonic Product Spectrum, the Harmonic Sum Spectrum and a Maximum Likelihood Estimate", Proceedings of the Symposium on Computer Processing in Communications, vol. XIX, Polytechnic Press: Brooklyn, New York, (1970), 779-797.
"U.S. Appl. No. 13/404,496, Advisory Action dated May 13, 2015", 3 pgs.
"U.S. Appl. No. 13/404,496, Advisory Action dated Aug. 20, 2014", 2 pgs.
"U.S. Appl. No. 13/404,496, Examiner Interview Summary dated Aug. 21, 2014", 2 pgs.
"U.S. Appl. No. 13/404,496, Final Office Action dated Jun. 3, 2014", 16 pgs.
"U.S. Appl. No. 13/404,496, Final Office Action dated Dec. 31, 2014", 17 pgs.
"U.S. Appl. No. 13/404,496, Non Final Office Action dated Feb. 13, 2014", 16 pgs.
"U.S. Appl. No. 13/404,496, Non Final Office Action dated Jun. 23, 2015", 18 pgs.
"U.S. Appl. No. 13/404,496, Non Final Office Action dated Sep. 18, 2014", 17 pgs.
"U.S. Appl. No. 13/404,496, Response filed Apr. 30, 2015 to Final Office Action dated Dec. 31, 2014", 10 pgs.
"U.S. Appl. No. 13/404,496, Response filed May 13, 2014 to Non Final Office Action dated Feb. 13, 2014", 8 pgs.
"U.S. Appl. No. 13/404,496, Response filed Aug. 4, 2014 to Final Office Action dated Jun. 3, 2014", 8 pgs.
"U.S. Appl. No. 13/404,496, Response filed Sep. 3, 2014 to Advisory Action dated Aug. 20, 2014", 8 pgs.
"U.S. Appl. No. 13/404,496, Response filed Dec. 18, 2014 to Non Final Office Action dated Sep. 8, 2014", 9 pgs.
"European Application Serial No. 14176621.2, Extended European Search Report dated Jan. 16, 2015", 6 pgs.
"U.S. Appl. No. 13/404,496, Final Office Action dated Oct. 30, 2015", 18 pgs.
"U.S. Appl. No. 13/404,496, Response filed Jan. 29, 2016 to Final Office Action dated Oct. 30, 2015", 10 pgs.
"European Application Serial No. 14176621.2, Extended European Search Report Response filed Aug. 20, 2015 to dated Jan. 16, 2015", 5 pgs.
"U.S. Appl. No. 13/404,496, Notice of Allowance dated Feb. 9, 2016", 7 pgs.
"European Application Serial No. 14176621.2, Communication Pursuant to Article 94(3) EPC dated Jun. 14, 2018", 5 pgs.
"U.S. Appl. No. 12/138,267 , Response filed Jan. 11, 2013 to Final Office Action dated Oct. 11, 2012", 9 pgs.
"U.S. Appl. No. 12/138,267 , Response filed Mar. 9, 2012 to Final Office Action dated Dec. 9, 2011", 8 pgs.
"U.S. Appl. No. 12/138,267 , Response filed Sep. 25, 2012 to Non Final Office Action dated Apr. 25, 2012", 10 pgs.
"U.S. Appl. No. 12/138,267, Advisory Action dated Jan. 24, 2013", 3 pgs.
"U.S. Appl. No. 12/138,267, Advisory Action dated Mar. 21, 2012", 3 pgs.
"U.S. Appl. No. 12/138,267, Final Office Action dated Oct. 11, 2012", 17 pgs.
"U.S. Appl. No. 12/138,267, Final Office Action dated Dec. 9, 2011", 16 pgs.
"U.S. Appl. No. 12/138,267, Non Final Office Action dated Apr. 25, 2012", 16 pgs.
"U.S. Appl. No. 12/138,267, Non Final Office Action dated Jun. 30, 2011", 16 pgs.
"U.S. Appl. No. 12/138,267, Response filed Sep. 30, 2011 to Non-Final Office Action dated Jun. 30, 2011", 11 pgs.
"U.S. Appl. No. 12/980,672, Final Office Action dated Feb. 22, 2013", 21 pgs.
"U.S. Appl. No. 12/980,672, Non Final Office Action dated Sep. 28, 2012", 17 pgs.
"U.S. Appl. No. 12/980,672, Response filed May 22, 2013 to Final Office Action dated Feb. 22, 2013", 12 pgs.

(56) References Cited

OTHER PUBLICATIONS

"U.S. Appl. No. 12/980,672, Response filed Dec. 28, 2012 to Non Final Office Action dated Sep. 28, 2012", 11 pgs.
"U.S. Appl. No. 13/404,496, Final Office Action dated Oct. 29, 2013", 14 pgs.
"U.S. Appl. No. 13/404,496, Non Final Office Action dated Apr. 16, 2013", 11 pgs.
"U.S. Appl. No. 13/404,496, Preliminary Amendment dated May 14, 2012", 3 pgs.
"U.S. Appl. No. 13/404,496, Response filed Jul. 16, 2013 to Non Final Office Action dated Apr. 16, 2013", 8 pgs.
"U.S. Appl. No. 13/408,826, Non Final Office Action dated May 28, 2013", 10 pgs.
"European Application Serial No. 08252008.1, Extended European Search Report dated Dec. 6, 2010", 10 Pgs.
"European Application Serial No. 08252008.1, Office Action dated Oct. 27, 2011", 5 pgs.
"European Application Serial No. 08252008.1, Response filed Jul. 1, 2011 to Extended European Search Report dated Dec. 6, 2010", 6 pgs.
"European Application Serial No. 08252008.1, Response filed Feb. 28, 2012 to Office Action dated Oct. 27, 2011", 10 pgs.
"European Application Serial No. 10252241.4, Extended Search Report Response filed Jan. 27, 2012", 11 pgs.
"European Application Serial No. 10252241.4; Search Report dated Mar. 31, 2011", 7 Pgs.

* cited by examiner

ACOUSTICALLY TRANSPARENT BARRIER LAYER TO SEAL AUDIO TRANSDUCERS

INCORPORATION BY REFERENCE

This application is related to U.S. Provisional patent application Ser. No. 13/404,496, filed on Feb. 24, 2012, which is incorporated herein by reference in its entirety.

FIELD OF THE INVENTION

The present subject matter relates generally to hearing device components, and in particular to apparatus and method for mitigation of earwax, oil, moisture, debris, and other foreign material for hearing device components.

BACKGROUND

One of the recurring problems with a body-worn device having transducers (e.g., acoustic sensors) is the accumulation of material that might block the proper operation of the transducer. Hearing assistance devices that are body worn and which have one or more transducers frequently encounter an accumulation of moisture, wax or other foreign material that can occlude apertures for the transducers and cause damage to the transducers eventually. One example of a hearing assistance device is a hearing aid. Hearing assistance devices often include on or more acoustic sensors, such as a microphone or receiver. These acoustic sensors are exposed to unwanted substances, such as wax, debris, moisture, or vapor. Hearing assistance devices may include a barrier layer arranged to reduce the amount of unwanted substances that can reach the acoustic sensor. However, occlusion and other effects of the buildup of wax, moisture and other materials continue to be an issue with such devices.

What is needed in the art is an improved method or apparatus for manufacturing barrier layers that meet requirements for acoustical transparency, resistance, repellency, and other characteristics. Such method and apparatus should not only improve the longevity of the transducers, but also provide reduced occurrences of partial or full blockage of apertures used for sound reception by hearing assistance devices. Such method and apparatus will allow less foreign material through to the transducer.

SUMMARY

Disclosed herein, among other things, are methods and apparatuses for providing a sealed and acoustically transparent barrier layer for mitigating foreign material buildup for hearing assistance device components.

The present subject matter includes a hearing assistance acoustically transparent barrier layer configured to resist accumulation and passage of foreign materials, wherein the barrier layer is acoustically transparent but prevents the accumulation and passage of unwanted materials. In various embodiments of the present subject matter, the barrier layer is a thin, low-density layer that is arranged around or on an exposed or open surface of an acoustic sensor. The barrier layer includes a membrane that is comprised of or coated with at least one of oleophobic and hydrophobic materials. The barrier layer neutral rest position is designed to move with its use environment changes, such as pressure or temperature, without introducing tension. In an embodiment, the balancing motion of sealed layer equalizes outside pressure with the internal pressure of sealed sensor(s) cavity, thereby reducing the need for pressure-equalizing leak path.

In one embodiment, where the ratio of internal volume of sealed cavity to barrier layer surface area is large, environmental changes require large motion for balancing motion of barrier layer. In such cases, slower environmental changes (e.g. hourly or daily static pressure variations) may be balanced by other or additional pressure balancing mechanisms. One such pressure balancing mechanism may include provision of leak passages through the capture frame of the barrier layer. The irregularities (e.g., "waviness") in the contact surface of the barrier layer and the mating capture frame can provide a minute leak passage. Another pressure balancing mechanism may include the use of porous plastic material in the capture frame. One other pressure balancing mechanism may include a narrow passage in the capture frame, where the narrow passage does not affect capture frame integrity. Other aspects are provided without departing from the scope of the present subject matter.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings that show, by way of illustration, specific aspects and embodiments in which the present subject matter may be practiced. These embodiments are described in sufficient detail to enable those skilled in the art to practice the present subject matter. References to "an," "one," or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter includes method and apparatus for preventing moisture, earwax, and other foreign materials from entering into a transducer (including, but not limited to, a microphone or receiver) of a hearing assistance device. The following examples will be provided for a hearing aid, which is only one type of hearing assistance device. It is understood however, that the disclosure is not limited to hearing aids and that the teachings provided herein can be applied to a variety of hearing assistance devices.

Different embodiments are provided in which a barrier layer configuration is used to protect the receiver and to reduce the effects of wax, moisture, and other unwanted substances. The present subject matter is demonstrated for hearing assistance devices, including hearing aids, including but not limited to, behind-the-ear (BTE), in-the-ear (ITE), in-the-canal (ITC), receiver-in-canal (RIC) or receiver-in-the-ear (RITE), completely-in-the-canal (CIC) type hearing aids, and deep insertion devices having a transducer, such as a receiver or microphone, whether custom fitted, standard, open fitted or occlusive fitted. The present subject matter can be used with any device having an acoustic transducer, and especially one configured to be placed in or proximal the ear canal of a wearer.

In order to shield acoustic sensors, barrier layers must meet several resistance and repellency requirements, and the barrier layer must be non-rigid, moveable, thin, lightweight, and stretch-resistant. To meet requirements and exhibit required characteristics, existing methods of creating barrier layers encounter several obstacles, including heat bonding, pressure leakage path, barrier resistance, and strain.

Figure 1A:
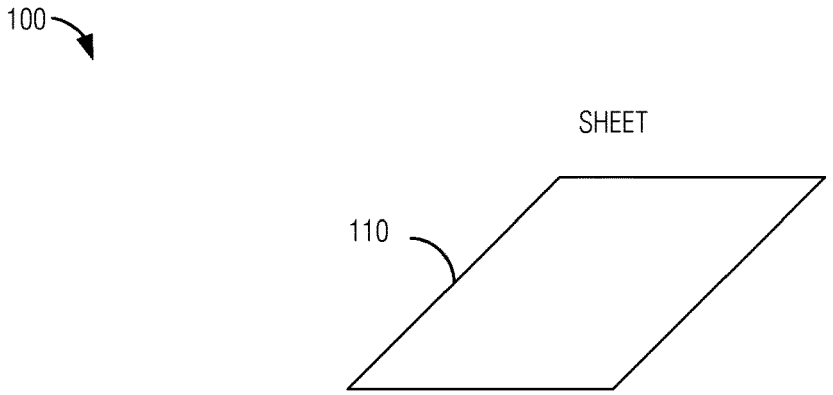
FIGS. 1A, 1B, and 1C are some example variations of form factors in which films are supplied according to one embodiment of the present subject matter.
Figure 1B:
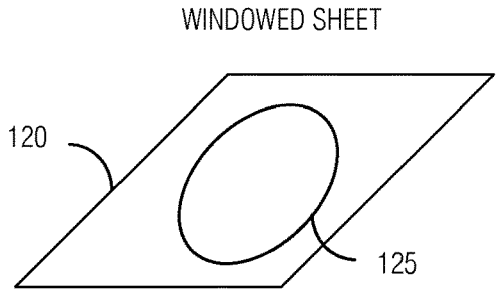
Figure 1C:
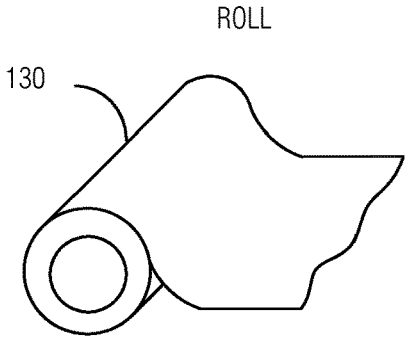

FIGS. 1A, 1B, and 1C are some example variations of form factors in which films are supplied 100 according to one embodiment of the present subject matter. Barrier films may be provided in a sheet form factor 110. Barrier films may be provided in a sheet form factor with a surrounding frame 120, where the frame improves the structural rigidity of the film for use in manufacturing processes. Barrier films may also be provided in a roll form factor 130. To generate a barrier layer with the desired resistance and repellency characteristics (e.g., including a high contact angle), existing barrier layer methods require a thick bondable membrane with a smooth interface surface. However, these layers are difficult to bond to a plastic substrate, and elaborate fixtures and time-consuming bonding processes (e.g., laser processes) increase the barrier layer manufacturing cost. The present subject matter improves barrier layer properties by selecting a chemically resistant and environmentally stable compound (e.g., cured or fluorinated compounds, copolymer, or blends thereof) or to coat barrier film with high molecular weight metallic layer.

Figure 2A:
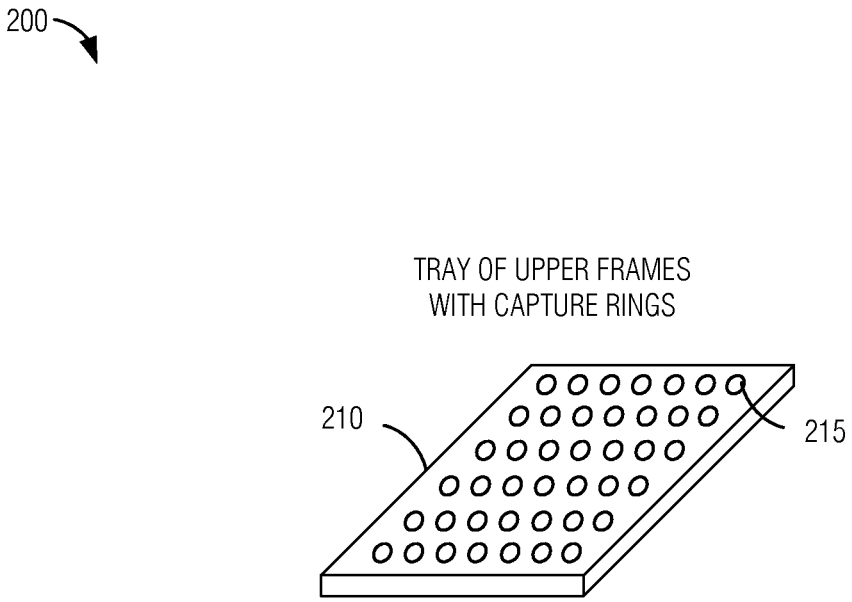
FIGS. 2A-2B are example trays according to one embodiment of the present subject matter.
Figure 2B:
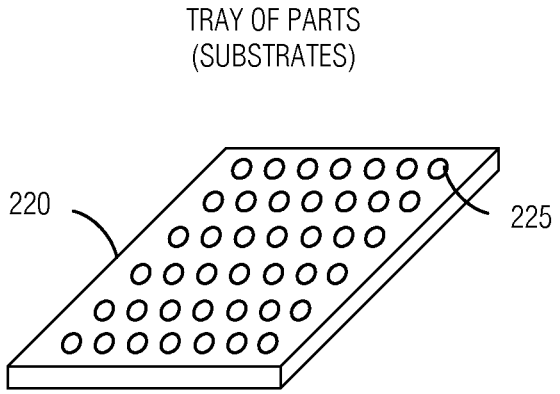

FIGS. 2A-2B are example trays 200 according to one embodiment of the present subject matter. The example trays 200 may include an upper frame 210 and a lower frame 220. The upper frame 210 may be formed of a rigid material, and may include an array of capture rings 215. The lower frame 220 may be formed of a rigid material, and may include an array of capture rings 225 that correspond to the upper frame capture rings 215. During manufacturing, a barrier film may be positioned between the upper frame 210 and the lower frame 220, and the combination of frames and barrier film may be separated into individual components corresponding to each of the capture rings 215 and 225.

Figure 3:
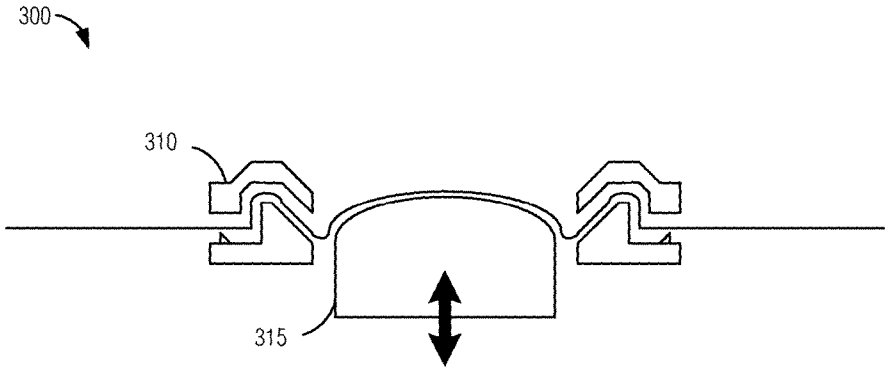
FIG. 3 is an example film press used to cut and stretch film according to one embodiment of the present subject matter.

FIG. 3 is an example film press 300 used to cut and stretch film according to one embodiment of the present subject matter. The film press 300 includes a film cutting and bonding mechanism 310, and a deformation mechanism 315. During barrier layer manufacturing, the film press 300 may bond a portion of the film to an upper frame 210 and lower frame 220. The bonding may be accomplished using mechanical snap/friction bonding, RF bonding, ultrasonic bonding, or injection molding bonding. To secure the barrier layer, existing barrier layer methods require heat bonding of a thin film to a plastic substrate. However, because most highly rated barrier films are not heat-bondable, heat bonding limits available choices for barrier films and mating substrates. Moreover, acoustic transparency requires very thin film that further complicates heat bonding process. Instead of bonding barrier films directly to substrate, the subject matter disclosed herein includes bonding two mating frames to capture thin film. The subject matter also facilitates film selection that is configured according to cost constraints and according to the environment in which the film will be used. The hardness and melt characteristics of plastic capture frame, ring, and base can be selected to match the requirements of the proper bonding method, where the bonding method may be sonic, heat, RF, insert molding, or mechanical capture. This allows freedom in choosing the best barrier material independent of its bond ability requirement, which allows the method to meet cost constraints by optimizing the capture process, cycle, and time. Furthermore, desired level of looseness in captured film, required for pressure balancing can be achieved by proper deformation of film during capture process regardless of film thickness, physical, chemical, surface properties, or bondability properties.

Figure 4:
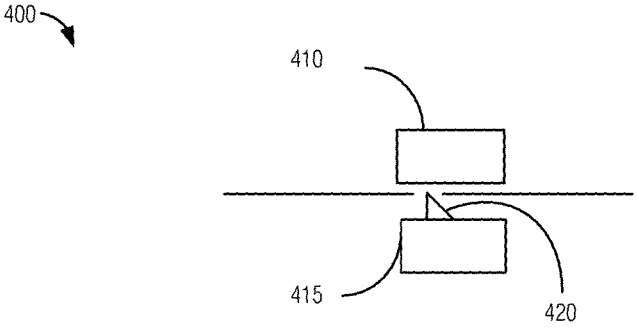
FIG. 4 is a cross-section of a film cutter used in a film press according to one embodiment of the present subject matter.

FIG. 4 is a cross-section of a film cutter 400 used in a film press 300 according to one embodiment of the present subject matter. The film cutter 400 includes a top compression mechanism 410, a bottom compression mechanism 415, and a cutting mechanism 420. When the top compression mechanism 410 is compressed against a bottom compression mechanism 415, the barrier film is pressed against the cutting mechanism 420 to separate a portion of the barrier film. The cutting mechanism 420 may separate the barrier film using mechanical cutting, heat cutting, ultrasonic cutting, or laser cutting. To accommodate windy or humid days, existing barrier layer methods require a pressure leakage (e.g., pressure equalization) path. However, the leakage path allows gas, vapor, or moisture to bypass the barrier layer and undermine its effectiveness. For example, on a windy and humid day, static atmospheric pressure can vary constantly due to the wind, and introduce a continual supply of moisture into an audio sensor through the leakage path. In another example, jaw motion (e.g., chewing) changes canal volume due to deformation of canal walls, which results in pressure variation. In-the-canal (ITC) and receiver-in-canal hearing assistance devices experience pressure variation within the canal. This pressure variation, although dampened by acoustical leak vent, allows water and wax vapor to penetrate into receiver through leakage path. The present subject matter barrier layer includes a barrier layer with a neutral rest position, which is designed to respond to expansion and contraction of trapped of sealed volume according to pressure or temperature changes in the environment in which it is used. The barrier layer is further designed to move without introducing excessive tension. The balancing motion of sealed barrier layer equalizes outside pressure with the internal pressure of sealed sensor cavity, thereby reducing the need for pressure-equalizing leak path.

Figure 5:
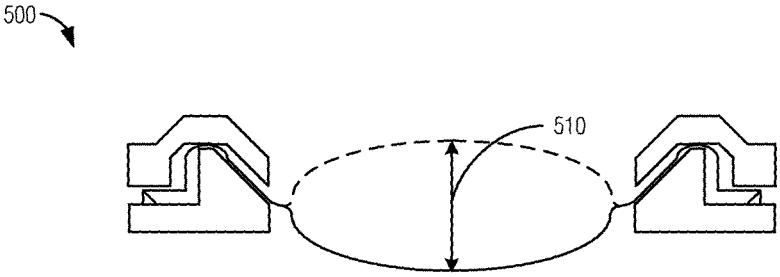
FIG. 5 shows a cut and bonded barrier film according to one embodiment of the present subject matter.

FIG. 5 shows a cut and bonded barrier film 500 according to one embodiment of the present subject matter. Once cut and bonded, the deformation mechanism 315 deforms the barrier film. Because of the deformation, the barrier film has a looseness 510. To generate a barrier layer with the desired acoustic transparency also requires a loose, lightweight bonded layer. However, bonding a very thin film by means of adhesive, thermal or laser beam to a suitable (e.g., bondable) substrate requires that the film to be under firm contact with substrate with no tension, which requires elaborate fixtures and time duration sensitive processes, all of which increase the barrier layer manufacturing cost. The present subject matter improves barrier layer manufacturability by capturing a film within a frame instead of bonding. Capturing designs work independent of film chemical structure, bondability, surface coating, and thickness. Film looseness (e.g., slack, flexibility) may be accomplished by deforming the barrier layer during the capture process. The barrier layer flexibility allows improved movement of barrier layer, and allows the barrier layer to adjust to pressure and temperature variations in the environment in which it is used. The elasticity (e.g., snap-back) of the barrier layer can cause the barrier layer to return to its original loose shape due to an unexpected large pressure unbalance force across barrier layer (e.g. during cleaning).

Figure 6A:
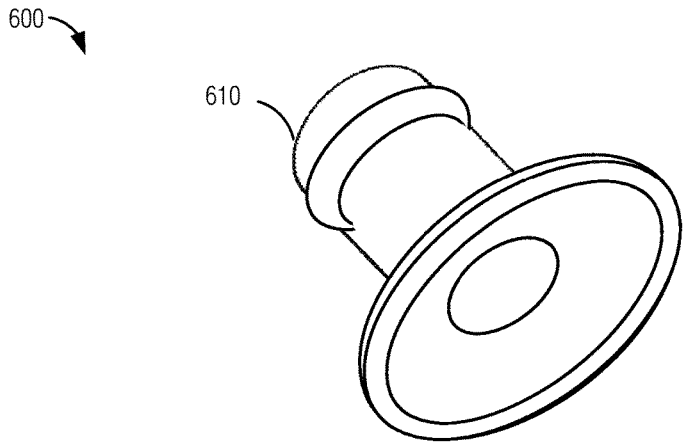
FIGS. 6A, 6B, and 6C are example variations of completed form factors in which films are used according to one embodiment of the present subject matter.
Figure 6B:
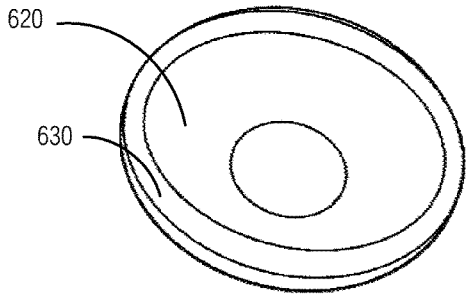
Figure 6C:
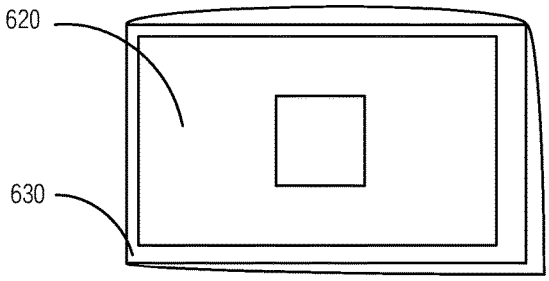

FIGS. 6A, 6B, and 6C are example variations of completed form factors 600 in which films are used according to one embodiment of the present subject matter. As is visible in FIG. 6A, the completed barrier film may be inserted into a plug 610, where the plug 610 may be inserted into a hearing assistance device. The barrier film may be mounted within an aperture 620 within the plug 610, such as is shown in FIGS. 6B and 6C. In various embodiment, the capture frame 630 may be circular as in FIG. 6B, or the capture frame 630 may be rectangular as in FIG. 6C. It is understood that the capture frame 630 may use other geometries without departing from the scope of this disclosure. The capture frame 630 may include one or more pressure balancing mechanisms, as shown in FIGS. 7 and 8.

Figure 7:
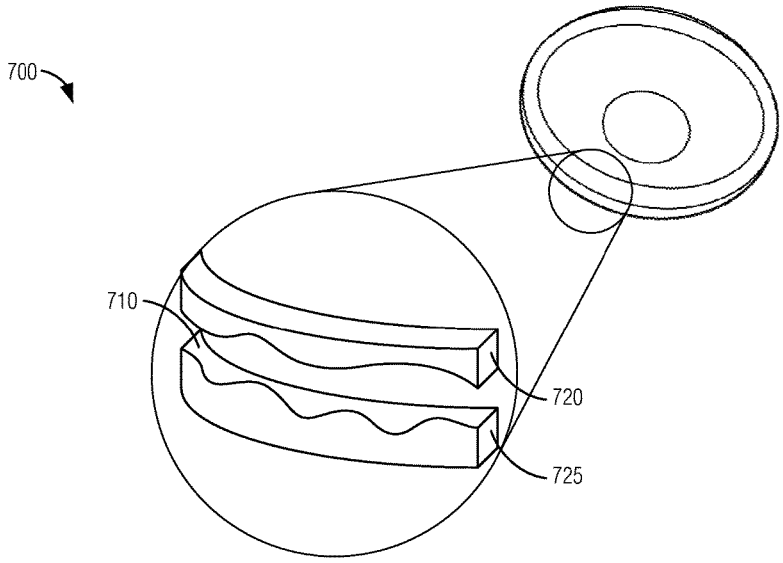
FIG. 7 is a cross-section of an irregular contact surface according to one embodiment of the present subject matter.

FIG. 7 is a cross-section of an irregular contact surface 700 according to one embodiment of the present subject matter. In some embodiments, slow environmental changes (e.g. hourly or daily static pressure variations) may be balanced by one or more pressure balancing mechanisms. Pressure balancing mechanisms may include configuring leak passages through the capture frame of the barrier layer. In an embodiment, one or more leak passages may be generated by configuring the contact surface of the barrier layer in an irregular (e.g., "wavy") pattern 710. The geometry of the irregularities in the capture rind (e.g., upper frame) 720 and in the capture seat (e.g., lower frame) 725 may be selected to provide one or more small leak passages to balance pressure.

Figure 8:
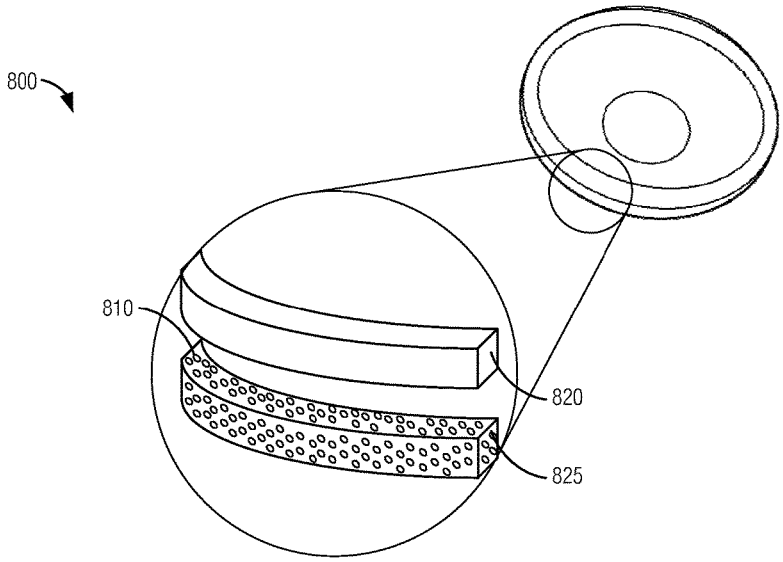
FIG. 8 is a cross-section of a porous contact surface according to one embodiment of the present subject matter.

FIG. 8 is a cross-section of a porous contact surface 800 according to one embodiment of the present subject matter. In an embodiment, pressure balancing mechanisms may also include use of a porous material 810 in the capture frame. In one embodiment, the capture rind 820 is non-porous and the capture seat 825 is porous, though other configurations may be used. The porosity of the material may be selected to provide one or more small leak passages to balance pressure. Other configurations of pressure balancing mechanisms may be used without departing from the scope of the present subject matter.

The present barrier prevents earwax, oils, moisture, and other foreign materials from reaching the transducer and causing damage. Therefore, this device will reduce repairs and warranty costs. Owners will not have to replace the barriers as frequently as other designs.

One aspect of the present subject matter is that in certain embodiments it provides a barrier to divert unwanted substances such as earwax, oils, moisture, and other foreign materials before entering an aperture. For example, by placing the barrier at an inlet, unwanted substances are diverted from the microphone or receiver or other device attached to or within the aperture. Thus, in certain embodiments, the present subject matter acts to divert unwanted substances as opposed to trapping them. In various embodiments, the barrier is accessible for cleaning. In certain applications, the barrier may be wiped clean.

Thus, several approaches and combinations of oleophobic and/or hydrophobic coatings, aperture shape, location, and sizes can be performed to migrate foreign material in such devices. The examples provided herein are not intended in an exclusive or exhaustive sense.

In one embodiment of the present subject matter, an apparatus includes a plug for protecting an acoustic transducer having an acoustic aperture with a known cross section, including a first portion that is generally hollow and elongate, the first portion having a shape substantially similar to the cross section geometry of the aperture of the acoustic transducer and configured to fit within the aperture of the acoustic transducer; and a second portion comprising a frame for capture of a substantially acoustically transparent thin film, the frame configured to be secured proximal to one end of the first portion, the frame configured to mechanically retain the film over at least a portion of the aperture of the acoustic transducer to maintain the film at a desired relaxed geometry to allow for free movement of the film, wherein the first portion and the second portion are shaped to be disposed within the aperture of the acoustic transducer and thereby retain the film to form an acoustically transparent plug with a barrier that prevents passage of foreign materials into the aperture to protect the acoustic transducer.

In some variations, the frame is configured in two pieces that mate to capture the film. In some embodiments, the plug includes two pieces that are configured to snap together, or the plug includes two pieces that are configured to mate using a compression fit. In some embodiments, the plug includes at least a portion of the frame that is made from an adhesive tape. In some embodiments, the plug includes at least a portion of the frame that is made from plastic, where the plug plastic may be porous plastic. In some embodiments, at least one of the two pieces that snap together is plastic, where the plastic of the two pieces that snap together may be porous plastic. In some embodiments, at least one of the two pieces that mate using a compression fit is plastic, where the plastic of the two pieces that mate using a compression fit may be porous plastic. In some embodiments, at least a portion of the plug includes hydrophobic materials, or at least a portion of the plug includes oleophobic materials. In some embodiments, the plug or two pieces may be made of one or more other materials.

In one embodiment of the present subject matter, a method for thin film capture for an acoustically transparent plug for a transducer includes cutting an acoustically transparent thin film; disposing the thin film within a capture frame; deforming the thin film; and capturing the thin film on the capture frame. The capturing the thin film on the capture frame may achieve a desired relaxed geometry to allow for free movement of the thin film, reduce accumulation of foreign materials, or reduce passage of foreign materials to a transducer when the capture frame is secured to an acoustic aperture of the transducer.

In some embodiments, the cutting includes mechanical cutting, heat cutting, ultrasonic cutting, or laser cutting. In some embodiments, the bonding includes mechanical snap fitting of the frame to capture the thin film, or friction fitting of the frame to capture the thin film. In some embodiments, the bonding includes RF bonding, ultrasonic bonding, or injection molding bonding. In some variations, the captured thin film is thermoplastic material, a thermoset material, or an elastomeric material. In some variations, the captured thin film is a blend of a thermoplastic material, a thermoset material, or an elastomeric material. In some variations, the thin film is loosely bonded to the substrate. In some variations, the thin film has predefined slack relative to a taut plane. In some embodiments, the thin film is metallic, such as using an aluminum film. In some variations, the thin film is coated with a metal, coated with a hydrophobic material, or coated with an oleophobic material. In some embodiments, the thin film is coated with a color-changing layer to indicate presence of oil or moisture, such that a visual observation of the film coating color may indicate that the film should be cleaned. In some embodiments, the thin film is a graphic material such as grapheme, and may exhibit characteristics such as low density or high strength. In some embodiments, the thin film may be made of one or more other materials.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used for devices with transducers generally, such as receivers for cochlear implant type hearing devices and such as deep insertion devices having a transducer, such as a receiver or microphone, whether custom fitted, standard, open fitted, or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A plug for protecting an acoustic transducer having an acoustic aperture with a known cross section, comprising:

a first portion that is generally hollow and elongate, the first portion having a shape substantially similar to the cross section geometry of the aperture of the acoustic transducer and configured to fit within the aperture of the acoustic transducer;

a non-porous substantially acoustically transparent thin barrier film deformed to a desired relaxed geometry; and a second portion comprising a frame for capture of the non-porous substantially acoustically transparent thin barrier film, the frame configured to be secured proximal to one end of the first portion, the frame configured to mechanically retain the film over at least a portion of the aperture of the acoustic transducer and configured to maintain the film at the desired relaxed geometry to allow for free movement of the film for pressure balancing in response to environment changes without requiring a pressure leakage path, wherein the first portion and the second portion are shaped to be disposed within the aperture of the acoustic transducer and thereby retain the film to form an acoustically transparent plug with a barrier that prevents passage of foreign materials into the aperture to protect the acoustic transducer.

2. The plug of claim 1, wherein the frame is configured in two pieces that mate to capture the film.

3. The plug of claim 2, wherein the two pieces are configured to snap together.

4. The plug of claim 2, wherein the two pieces are configured to mate using a compression fit.

5. The plug of claim 2, wherein at least a portion of the frame is made from an adhesive tape.

6. The plug of claim 2, wherein at least a portion of the frame is made from plastic.

7. The plug of claim 6, wherein the plastic is porous plastic.

8. The plug of claim 3, wherein at least one of the two pieces is plastic.

9. The plug of claim 8, wherein the plastic is porous plastic.

10. The plug of claim 4, wherein at least one of the two pieces is plastic.

11. The plug of claim 10, wherein the plastic is porous plastic.

12. The plug of claim 1, wherein at least a portion of the plug comprises hydrophobic materials.

13. The plug of claim 1, wherein at least a portion of the plug comprises oleophobic materials.

14. A method for thin film capture for an acoustically transparent plug for a transducer, comprising:

cutting a non-porous acoustically transparent thin barrier film;

disposing the thin film within a capture frame;

deforming the thin film to a desired relaxed geometry within the capture frame; and capturing the thin film on the capture frame to achieve the desired relaxed geometry to allow for free movement of the thin film for pressure balancing in response to environment changes without requiring a pressure leakage path, to reduce accumulation of foreign materials, and to reduce passage of foreign materials to a transducer when the capture frame is secured to an acoustic aperture of the transducer.

15. The method of claim 14, wherein the cutting includes mechanical cutting.

16. The method of claim 14, wherein the cutting includes heat cutting.

17. The method of claim 14, wherein the cutting includes ultrasonic cutting.

18. The method of claim 14, wherein the cutting includes laser cutting.

19. The method of claim 14, wherein the capturing includes mechanical snap fitting of the frame to capture the thin film.

20. The method of claim 14, wherein the capturing includes friction fitting of the frame to capture the thin film.

21. The method of claim 14, wherein the capturing includes RF bonding.

22. The method of claim 14, wherein the capturing includes ultrasonic bonding.

23. The method of claim 14, wherein the capturing includes injection molding bonding.

24. The method of claim 14, wherein the captured thin film is thermoplastic material, a thermoset material, or an elastomeric material.

25. The method of claim 14, wherein the captured thin film is a blend of a thermoplastic material, a thermoset material, or an elastomeric material.

26. The method of claim 14, wherein the thin film is loosely bonded to the substrate.

27. The method of claim 14, wherein the thin film has predefined slack relative to a taut plane.

28. The method of claim 14, wherein the thin film is metallic.

29. The method of claim 14, wherein the thin film is coated with a metal.

30. The method of claim 14, wherein the thin film is coated with a hydrophobic material.

31. The method of claim 14, wherein the thin film is coated with an oleophobic material.

32. The method of claim 14, wherein the thin film is coated with a color-changing layer to indicate presence of oil or moisture.

33. The method of claim 14, wherein the thin film is a graphic material.

* * * * *